US009341102B2

(12) United States Patent
Ross et al.

(10) Patent No.: US 9,341,102 B2
(45) Date of Patent: May 17, 2016

(54) CONFORMAL TRANSVERSE MUFFLER

(71) Applicant: Ford Global Technologies, LLC, Dearborn, MI (US)

(72) Inventors: Brian Ross, Marine City, MI (US); Joel John Beltramo, West Bloomfield, MI (US); Erich James Nowka, Ann Arbor, MI (US); Kerry Timothy Havener, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/318,410

(22) Filed: Jun. 27, 2014

(65) Prior Publication Data

US 2014/0311822 A1 Oct. 23, 2014

Related U.S. Application Data

(62) Division of application No. 13/692,943, filed on Dec. 3, 2012, now Pat. No. 8,827,035.

(51) Int. Cl.

| | |
|---|---|
| ***F01N 13/04*** | (2010.01) |
| ***F01N 13/08*** | (2010.01) |
| ***F01N 1/02*** | (2006.01) |
| ***F01N 13/18*** | (2010.01) |
| ***F01N 13/00*** | (2010.01) |
| *F01N 1/00* | (2006.01) |

(52) U.S. Cl.

CPC *F01N 13/08* (2013.01); *F01N 1/02* (2013.01); *F01N 13/00* (2013.01); *F01N 13/1888* (2013.01); *F01N 2490/16* (2013.01)

(58) Field of Classification Search

CPC ..... F01N 1/083; F01N 1/089; F01N 1/003; F01N 1/02

USPC ..... 181/282, 269, 272, 275, 238, 239

See application file for complete search history.

(56) References Cited

U.S. PATENT DOCUMENTS

| | | | |
|---|---|---|---|
| 1,280,386 | A | 10/1918 | Buehner |
| 2,660,257 | A | 11/1953 | Bourne et al. |
| 2,692,025 | A | 10/1954 | Maxim |
| 2,878,888 | A | 3/1959 | Abarth |

(Continued)

FOREIGN PATENT DOCUMENTS

| | | | |
|---|---|---|---|
| JP | S62615 | A | 1/1987 |

OTHER PUBLICATIONS

Anonymous, "Built-in Silencers to Suppress Defroster Noise—for Defrost and Floor modes," IPCOM No. 000141347, Published Oct. 4, 2006, 2 pages.

(Continued)

*Primary Examiner* — Edgardo San Martin

(74) *Attorney, Agent, or Firm* — James Dottavio; Alleman Hall McCoy Russell & Tuttle LLP

(57) ABSTRACT

Embodiments in accordance with the present disclosure may provide a muffler comprising an enclosure. The enclosure, in one example, may include a relatively thin volume fittable under a preselected feature of a vehicle, and at least one relatively thick volume fittable alongside the preselected feature. The enclosure may also include an exhaust gas entry port and a tailpipe exit port. In one example, partitions may be within the thin volume forming an expansion chamber at the entry port and a tailpipe extension at the exit port.

17 Claims, 8 Drawing Sheets

(56) References Cited

U.S. PATENT DOCUMENTS

| | | | | | |
|---|---|---|---|---|---|
| 2,940,249 | A | | 6/1960 | Gospodar | |
| 2,961,059 | A | | 11/1960 | Blair | |
| 3,070,187 | A | | 12/1962 | Deremer | |
| 3,189,122 | A | | 6/1965 | Martin | |
| 3,388,769 | A | | 6/1968 | Martoia | |
| 3,709,320 | A | | 1/1973 | Höllerl et al. | |
| 3,827,529 | A | | 8/1974 | Frietzsche et al. | |
| 3,949,829 | A | | 4/1976 | Honda et al. | |
| 4,064,963 | A | | 12/1977 | Kaan et al. | |
| 4,132,286 | A | | 1/1979 | Hasui et al. | |
| 4,133,479 | A | | 1/1979 | Musitano et al. | |
| 4,359,865 | A | | 11/1982 | Nakao et al. | |
| 4,416,350 | A | * | 11/1983 | Hayashi | F01N 1/02 181/265 |
| 4,422,519 | A | * | 12/1983 | Nomura | F01N 1/08 180/219 |
| RE31,724 | E | | 11/1984 | Isaka | |
| 4,487,288 | A | | 12/1984 | Watanabe et al. | |
| 4,760,894 | A | | 8/1988 | Harwood et al. | |
| 4,909,348 | A | | 3/1990 | Harwood et al. | |
| 4,949,807 | A | | 8/1990 | Hirata et al. | |
| 4,953,352 | A | | 9/1990 | Campbell | |
| 5,004,069 | A | | 4/1991 | Van Blaircum et al. | |
| 5,046,977 | A | | 9/1991 | Rodskier | |
| 5,259,797 | A | | 11/1993 | Miles, Jr. et al. | |
| 5,265,420 | A | | 11/1993 | Rutschmann | |
| 5,321,214 | A | * | 6/1994 | Uegane | B60K 13/04 181/211 |
| 5,473,891 | A | * | 12/1995 | Baxter | F01N 13/08 181/238 |
| 5,773,770 | A | | 6/1998 | Jones | |
| 6,931,367 | B2 | | 8/2005 | Harwood | |
| 6,935,461 | B2 | | 8/2005 | Marocco | |
| 7,104,359 | B1 | | 9/2006 | Zelinski | |
| 7,377,359 | B2 | | 5/2008 | Hofmann et al. | |
| 7,637,349 | B2 | | 12/2009 | Harada | |
| 7,650,965 | B2 | | 1/2010 | Thayer et al. | |
| 7,789,195 | B2 | | 9/2010 | Mabuchi et al. | |
| 7,895,832 | B2 | * | 3/2011 | Gruber | F01N 1/02 181/227 |
| 8,028,798 | B2 | | 10/2011 | Koyanagi et al. | |
| 8,827,035 | B2 | * | 9/2014 | Ross | F01N 13/1888 181/238 |
| 8,939,254 | B2 | * | 1/2015 | Schmitt | F01N 13/082 181/228 |
| 9,121,320 | B2 | * | 9/2015 | Carr | F01N 1/086 |
| 2008/0110155 | A1 | | 5/2008 | Harada | |
| 2009/0000862 | A1 | * | 1/2009 | Buell | F01N 1/083 181/212 |
| 2015/0008068 | A1 | * | 1/2015 | Hamashima | F01N 13/1888 181/228 |

OTHER PUBLICATIONS

Anonymous, "Enhanced Flow Control Airflow Register," IPCOM No. 000141357, Published Oct. 4, 2006, 2 pages.

* cited by examiner

CONFORMAL TRANSVERSE MUFFLER

CROSS REFERENCE TO RELATED APPLICATIONS

The present application is a divisional of U.S. patent application Ser. No. 13/692,943, "CONFORMAL TRANSVERSE MUFFLER," filed on Dec. 3, 2012, the entire contents of which are hereby incorporated by reference for all purposes.

FIELD

The present application relates generally to vehicle exhaust noise attenuation, including a conformal transverse muffler shaped to fit around a bottom and a side of vehicle features, such as a spare tire well.

BACKGROUND AND SUMMARY

The repeated expulsion of exhaust gas from an engine may cause pulsed rapid movement of the gas through one or more exhaust pipes and out of one or more tail pipes. The pulsed rapid movement may create compression waves and objectionable noise, vibration and harshness (NVH). Exhaust mufflers have been used to reduce the noise. They typically serve to damp the noise, and/or to bounce the compression waves against partitions inside the muffler to create wave interference patterns to reduce the overall amplitude of the waves. Mufflers typically have an elongated oval shape, and an inlet at one longitudinal end and an outlet at the opposite end.

Tubing length and muffler volume can both help reduce noise. However, both parameters are often constrained by package limitations, especially in modern vehicles. At the same time, modern boosting techniques push more mass flow through the engine and exhaust system, potentially increasing exhaust noise.

One effort to reduce the proportion of space occupied by the vehicle muffler and exhaust tubing is disclosed in U.S. Pat. No. 4,760,894 to Harwood et al. Harwood discloses an exhaust muffler configured to accommodate a greater proportion of the available space on the vehicle. Harwood's approach recognizes a greater availability of transverse pockets of space available under the vehicle, which can require large bend tubing. To avoid large bend radius tubing, Harwood proposes a muffler with an internal configuration such that the exhaust pipe, or the tailpipe, may enter the muffler at an angle with the longitudinal axis of the muffler.

The inventors herein have recognized a number of problems with this approach. For example, the approach disclosed proposes a muffler having a substantially monolithic shape, and the resulting exhaust configuration still does not make significantly efficient use of the pockets of space under the vehicle.

Embodiments in accordance with the present disclosure may provide a conformal transverse muffler including an enclosure shaped to fit around a bottom and a side of a spare tire well of a vehicle. The enclosure may include a mid section fittable below the spare tire well, and two side sections fittable in opposite locations only radially outside of a circumference of the spare tire well. The side sections may be thicker than the mid section and may have a vertical center above a vertical center of the mid section. In this way, the available space under the vehicle may be effectively used by conforming the muffler shape to available space, thus enabling increased muffler volume within available packaging, such as for boosted engines. Further, in one example, this positioning and shaping of the muffler enables increased size of the vehicle trunk.

In one example, internal tubing may be coupled within a conformal muffler, such as described herein, and span transversely across the width to enable longer exhaust tailpipe lengths due to the wider lengths accommodated, thus meeting noise targets while also addressing backpressure issues. Such an approach is especially beneficial with dual exhaust tailpipes, since both may traverse the muffler's width in opposite directions to reduce package requirements.

Still another potential advantage is that the muffler may operate as an aerodynamic shield on the bottom of the vehicle due to its relative position under the spare tire, thus enabling improved fuel economy without requiring an additional shield, if desired.

Note that the conformal muffler may apply to single exhaust pipe systems, dual exhaust pipe systems, or systems having more exhaust pipes, as well as combinations thereof. For example, the conformal muffler may have a single exhaust inlet and a single exhaust outlet, multiple exhaust inlets and a single exhaust outlet, a single exhaust inlet and multiple exhaust outlets, duel inlets and duel outlets, or still further variations.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-13 are drawn approximately to scale, although other relative dimensions may be used.

DETAILED DESCRIPTION

Figure 1:
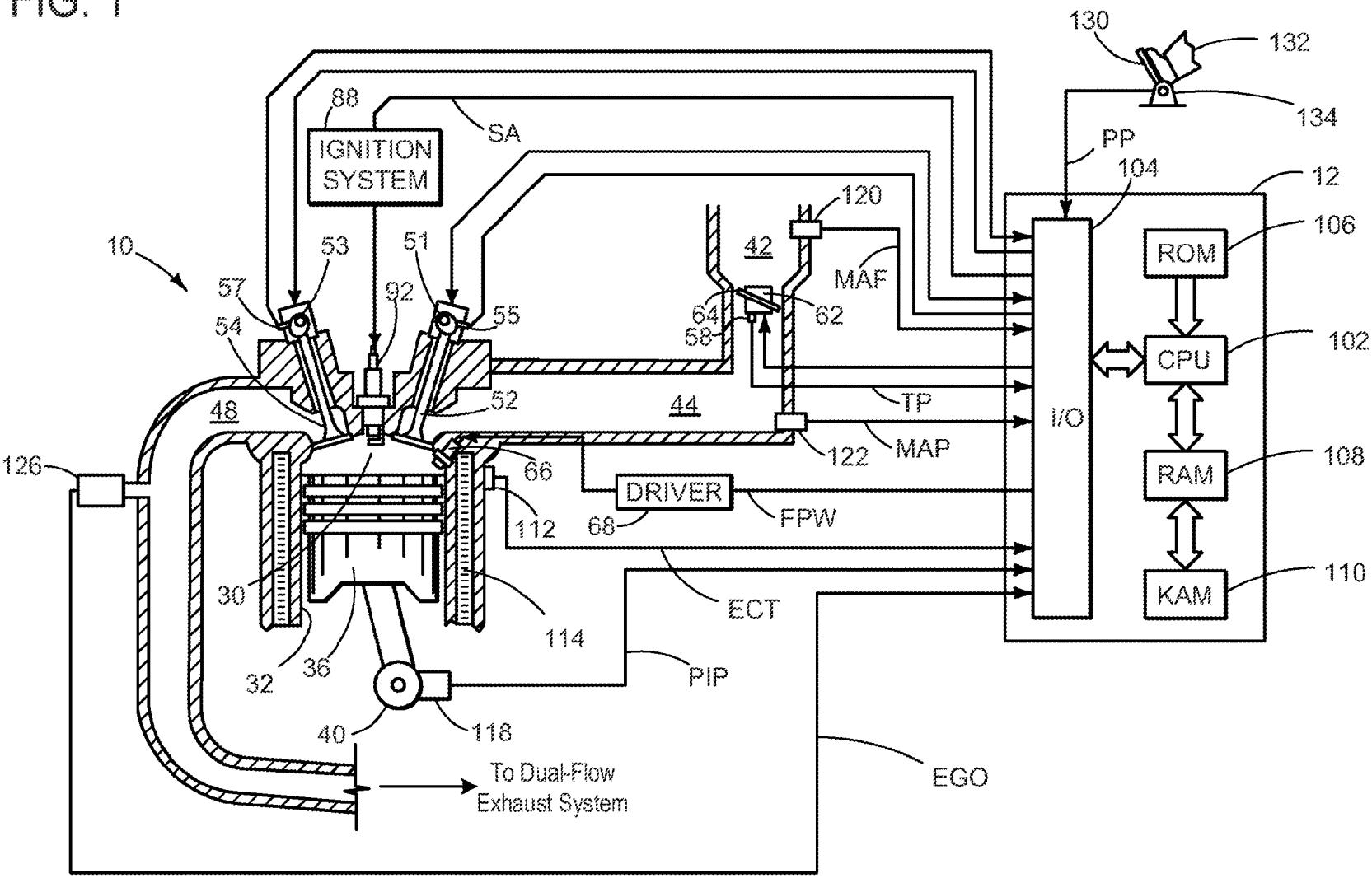
FIG. 1 is a partial cross sectional schematic view illustrating a portion of an example engine system, i.e. that of an internal combustion engine in accordance with the present disclosure.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Engine 10 may include a turbocharger in one example to boost intake air entering the engine. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Additionally or alternatively fuel may be injected upstream of intake valve 52 via a fuel injector (not shown), which is known to those skilled in the art as port injection.

Ignition system 88 provides an ignition spark to combustion chamber 30 via spark plug 92 in response to controller 12. Universal Exhaust Gas Oxygen (UEGO) sensor 126 is shown coupled to exhaust manifold 48. Alternatively, a two-state exhaust gas oxygen sensor may be substituted for UEGO sensor 126.

Various components such as a convertor, acoustic attenuation devices (e.g., resonator, muffler), etc., may be in fluidic communication with exhaust manifold 48. The convertor and acoustic attenuation devices may be included in a dual-flow exhaust system. Therefore, it will be appreciated that engine 10 may include a second exhaust manifold coupled to another combustion chamber. The dual-flow exhaust system is discussed in greater detail herein with regard to FIGS. 2A and 2B.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing the position of the accelerator pedal 130 which may be adjusted by a force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2B:
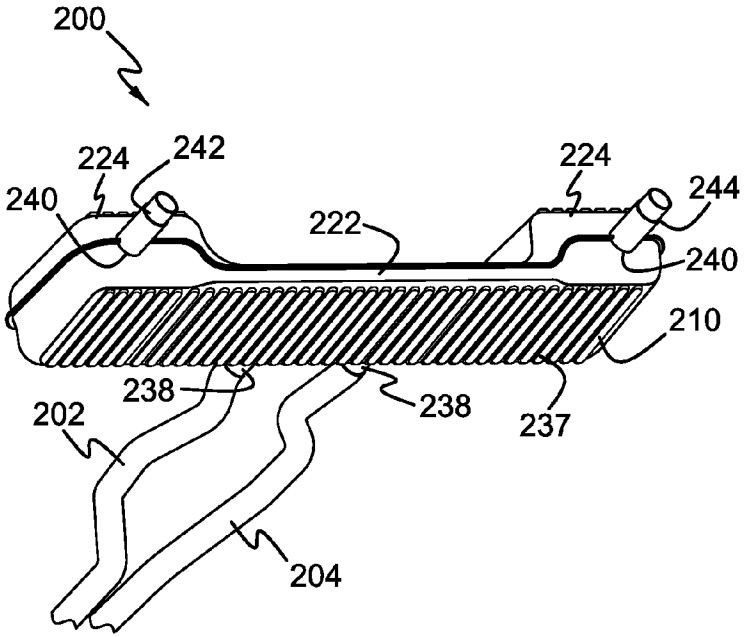
FIGS. 2A and 2B are respective top and bottom perspective views illustrating a portion of an example exhaust system in accordance with the present disclosure.
Figure 2A:
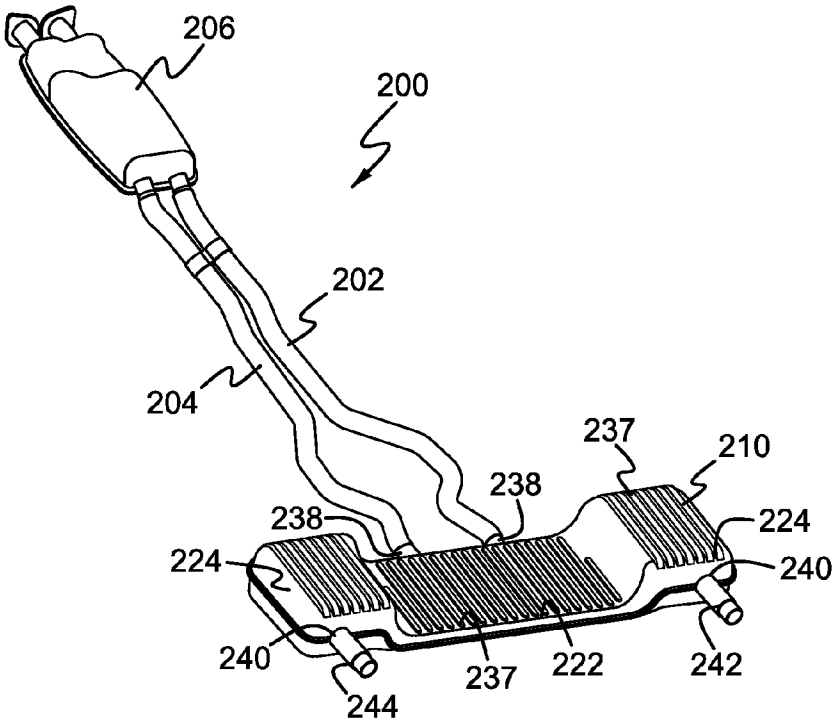

FIGS. 2A and 2B are respective top and bottom perspective views illustrating a portion of an example dual, or dual flow, exhaust system 200 in accordance with the present disclosure. It will be understood that a dual-flow exhaust system 200 includes a first exhaust conduit, passage, or first exhaust pipe 202, and a second exhaust conduit, passage, or second exhaust pipe 204 for directing exhaust gases away from an engine. As discussed above with regard to FIG. 1 the intake system may include a throttle 62, intake manifold 44, etc. Thus, the intake system may be configured to provide air to the engine for combustion. It will be appreciated that additional systems may be included in example vehicles which are not depicted in FIG. 2. For example, an exhaust gas recirculation (EGR) system and/or boosting system (e.g., supercharger, turbocharger) may be provided in other embodiments.

The engine may include a number of cylinders, for example six cylinders in two cylinder banks. It will be appreciated that the engine may include an alternate number of cylinders, and/or banks, in other embodiments. The cylinders may be divided into a first cylinder bank and a second cylinder bank. Furthermore, the cylinders may be in a V type of configuration, in which the central axes of each opposing cylinder intersect at a non-straight angle. However, other cylinder configurations may be utilized in other embodiments, such as a flat or inline cylinder configuration. The engine's displacement may be for example 3.7 liters. However, other displacements may be used. The cylinders included in both of the cylinder banks may be coupled to the example dual-flow exhaust system 200 illustrated. The dual-flow exhaust system 200 may include a first exhaust pipe 202 coupled to a first cylinder bank. Specifically, the first exhaust pipe 202 may includes an input exclusively coupled to the first cylinder bank. Likewise the second exhaust pipe 204 may be coupled to a second cylinder bank. Specifically, the second exhaust pipe 204 may include an input exclusively coupled to the second cylinder bank. The dual-flow exhaust system 200 may further include a resonator and/or emission control sub-system 206 coupled to the first and second exhaust conduits. The sub-system 206 may include one or more devices, such as particulate filters, convertors, resonator, etc. In one example, the emission control system may include a convertor including multiple catalyst bricks. In another example, multiple emission control devices, each with multiple bricks, can be used. It will be appreciated that exhaust conduits (i.e., the first and second exhaust pipes 202 and 204) may be fluidically separated in the emission control sub-system 206. In other words, mixing of the exhaust gases from the first and second exhaust conduits may be inhibited in the emission control sub-system to maintain separated exhaust streams. It should be noted that this muffler may be used with single exhaust systems as well, and is not limited to systems with two or more exhaust pipes.

Various example embodiments may use a muffler as indicated in the figures, or one or more mufflers modified in accordance with the present disclosure that may be used with a single inlet/single outlet, single inlet/dual outlet, dual inlet/single outlet, or dual inlet/dual outlet configurations. Some example embodiments may use a single outlet configuration wherein the outlet may be placed on the left side or on the right side of the vehicle. One example may place the outlet substantially in the center of the vehicle. Some embodiments may provide various levels of flexibility by enabling an inlet, or an outlet to be plugged, and/or sealed. Internal baffling, and/or routing may be rearranged, or otherwise modified on some cases.

As discussed above combustion may be implemented via intake and exhaust valve actuation. Consequently, pulses of high pressure exhaust gases may be generated in the exhaust stream, thereby generating sound waves propagating downstream in the dual-flow exhaust system. It will be appreciated that the frequency and amplitude of the sound waves generated in the exhaust streams may depend upon the valve timing, fuel injection timing, engine speed, engine displacement, etc. It may be desirable to decrease and in some cases eliminate at least a portion of the sound waves generated in the engine and propagated through the dual-flow exhaust system to reduce noise pollution generated by the vehicle and provide the driver with a more agreeable driving experience. Therefore, muffler 210 may also be included in the dual-flow exhaust system 200. The muffler 210 may be configured to attenuate a desired audible frequency or range of audible frequencies within the exhaust system 200 via, for example, destructive interference within an enclosure of the muffler 210. In this way, noises generated via the engine may be reduced.

It will be appreciated that the exhaust system 200, and the muffler 210 described herein may also, or instead, be used with any number of other engine types, and/or configurations. For example the muffler 210, or variations thereof, could be applied to a Wankel (Rotary) engine, an Atkinson cycle engine, a Diesel cycle engine, or other internal combustion engine that may be employed in a various vehicles.

Figure 3:
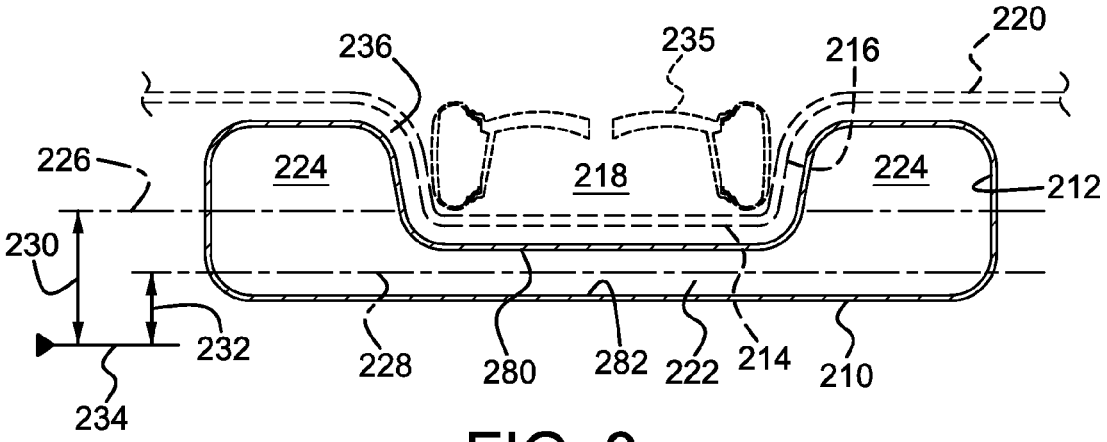
FIG. 3 is a sectional view of a sample muffler in accordance with the present disclosure located in an example position within a vehicle, part of which is shown with dashed lines.

FIG. 3 is a sectional view of a sample muffler 210 in accordance with the present disclosure shown located in an example position within a vehicle 220, part of which is shown with dashed lines. Embodiments may include a conformal transverse muffler 210 which may include an enclosure having two side sections 224 and mid section 222 formed therebetween. The mid section may have a height less than a height of either of the side sections. In some cases the enclosure may be configured to fit around a bottom and a side of one or more vehicle features. Example vehicle features may include, but may not be limited to: one or more batteries, various storage compartments, a spare tire well, and a driveline. In one example the mid section may be fitable below a spare tire well. For example, a hybrid-electric vehicle may include an engine and exhaust system such as described herein, and may house batteries in a selected location below a vehicle trunk. As such, it may be advantageous to apply the conformal muffler approach to fit around a battery well including a plurality of batteries.

Some embodiments may include a conformal transverse muffler 210 which may include an enclosure 212 shaped to fit around a bottom 214 and a side 216 of a spare tire well 218 of the vehicle 220. The enclosure 212 may include a mid section 222 fittable below the spare tire well 218. The enclosure 212 may also include two side sections 224 fittable in opposite locations only radially outside of a circumference of the spare tire well 218. The side sections 224 may be thicker than the mid section 222 and may have a vertical center 226 above a vertical center 228 of the mid section 222 as indicated by a first distance 230 shown longer than a second distance 232 from a common reference datum 234. A tire 235 is shown in dashed lines in the spare tire well 218. In some embodiments the side sections 224 may be at least partially coplanar with the spare tire well 218.

The muffler 210 and the spare tire well 218 may have a space 236 therebetween. The space 236 may provide, for example thermal, or acoustical, insulation between the muffler 210 and the vehicle 220. With some examples the enclosure includes a number of surfaces having corrugated contours 237.

Referring also again to FIGS. 2A and 2B wherein the mid section 222 of the muffler 210 may include two inlets 238 each respectively configured to be coupled with dual exhaust pipes 202 and 204 for exhausting gas from two respective banks of cylinders of a combustion engine. In addition, each side section 224 may include two outlets 240 each respectively configured to be coupled with tailpipes pipes 242 and 244.

Figure 4:
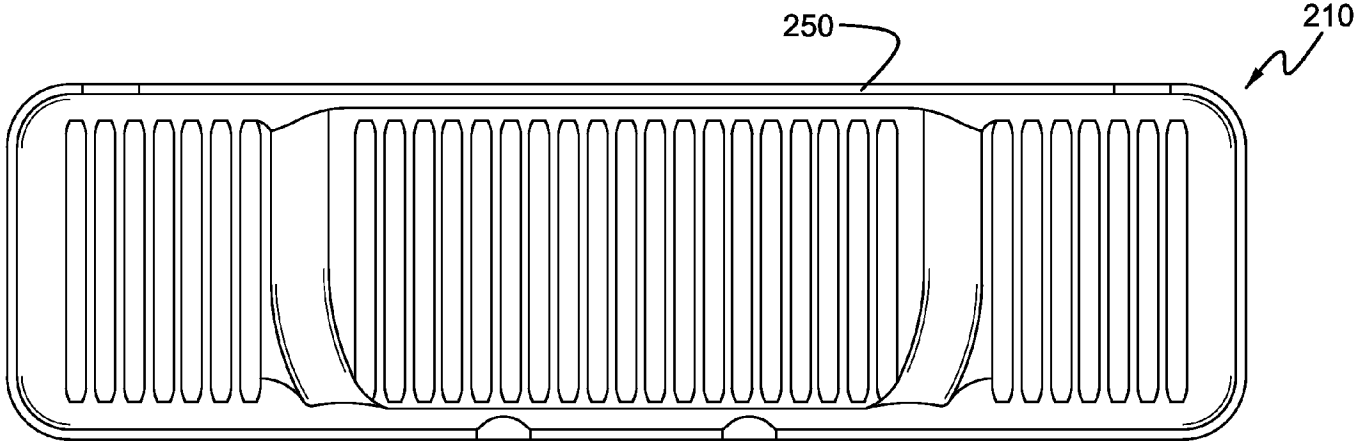
FIG. 4 is a bottom view of a top portion of an example muffler in accordance with the present disclosure.
Figure 5:
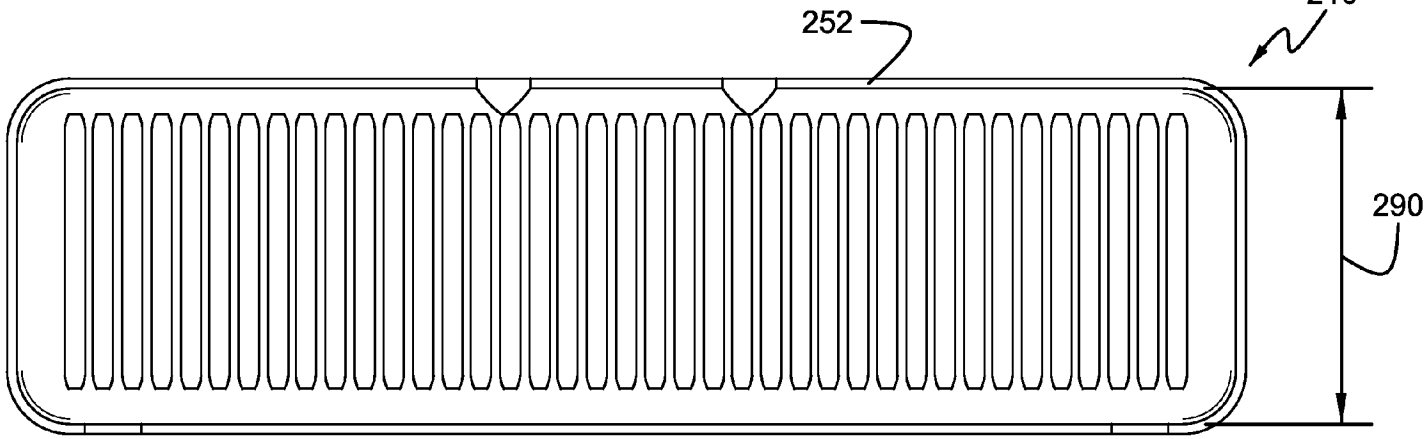
FIG. 5 is a top view of a bottom portion of the example muffler shown in FIG. 4.
Figure 6:
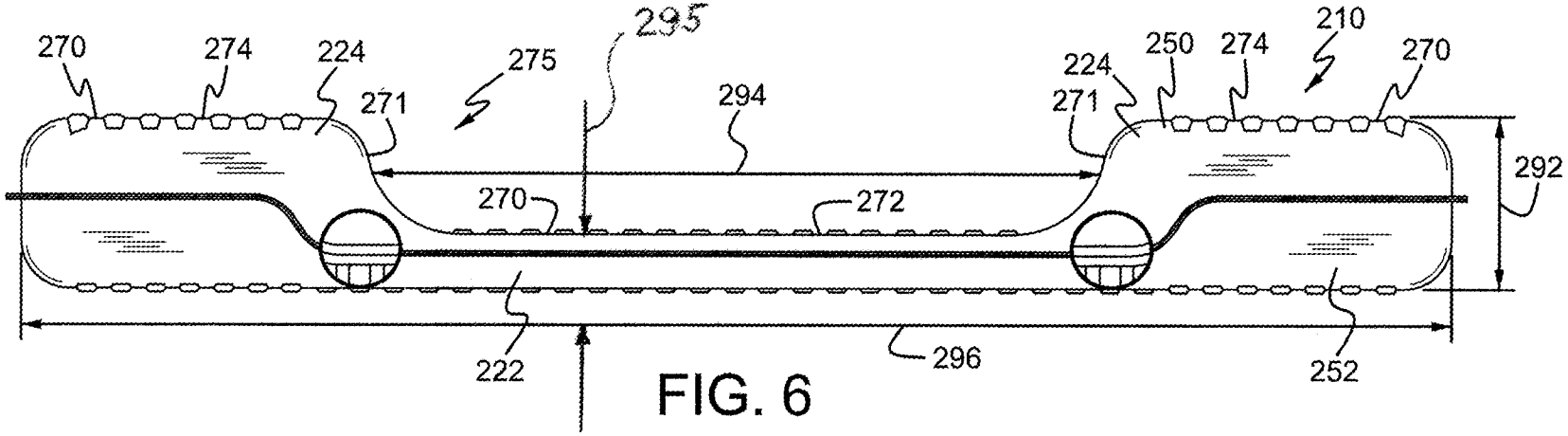
FIG. 6 is a front view of the top portion shown in FIG. 4 coupled with the bottom portion shown in FIG. 5.
Figure 7:
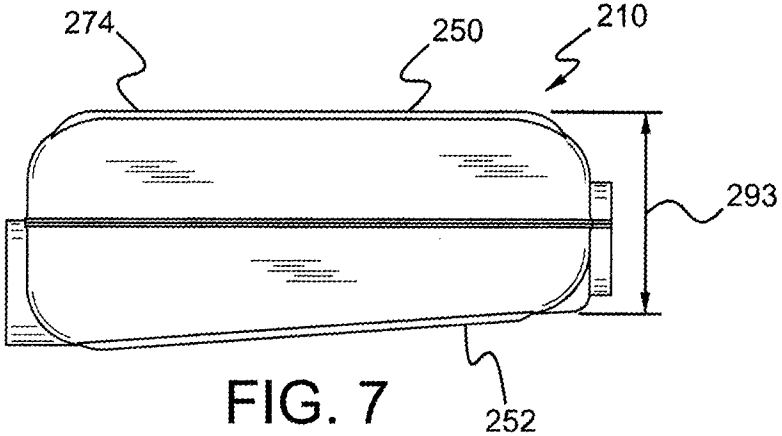
FIG. 7 is a side view of the example muffler shown in FIG. 6.

FIG. 4 is a bottom view of a top portion 250, or top shell, of the example muffler 210 in accordance with the present disclosure. FIG. 5 is a top view of a bottom portion 252, or bottom shell, of the muffler 210. FIG. 6 is a front view of the muffler 210 illustrating the top portion 250 coupled with the bottom portion 252; and FIG. 7 is a side view of the muffler 210. The top portion 250, and the bottom portion 252 may have a preselected depth as indicated by dimension 290 in FIG. 5. With at least one example embodiment this dimension may be approximately 400 mm. Other dimensions may be used. When the top portion 250 and the bottom portion are coupled together the muffler 210 may have a preselected height, at least at a first end thereof as indicated by dimension 292 in FIG. 6. With at least one example embodiment dimension 292 may be approximately 175 mm. Other dimensions may be used. In some cases the mid section 222 may have a preselected height, as indicated by dimension 295 in FIG. 6. With at least one example embodiment dimension 295 may be, for example, approximately 55 to 60 mm. Other dimensions may be used. A height of second end thereof may be indicated by dimension 293 in FIG. 7. With at least one example embodiment dimension 293 may be approximately 150 mm. Other dimensions may be used. A nominal distance between opposite inner sides of the side volumes 224 may be indicated by dimension 294 in FIG. 6. With at least one example embodiment dimension 294 may be approximately 755 mm. Other dimensions may be used. The overall width of the muffler 210 may be indicated with dimension 296 in FIG. 6. With at least one example embodiment dimension 296 may be approximately 1360 mm. Other dimensions may be used. An internal volume of the muffler 210 may be for example 40 liters, although other volumes may be used.

The relatively higher side surfaces 274 may define the top of the muffler 210. The location of the top of the muffler 210 may be defined by a rear rail structure of the vehicle 220. The bottom 273 of the muffler 210 may be defined by a ground clearance plane. The bottom 273 of the muffler 210 may be defined by other, or additional, considerations as well. For example, the bottom surface of the muffler may be defined by any aerodynamic shaping. As previously mentioned, the muffler 210 may operate as an aerodynamic shield on the bottom of the vehicle. This may enable improved fuel economy without requiring an additional shield. In this way costs may be reduced.

Figure 8:
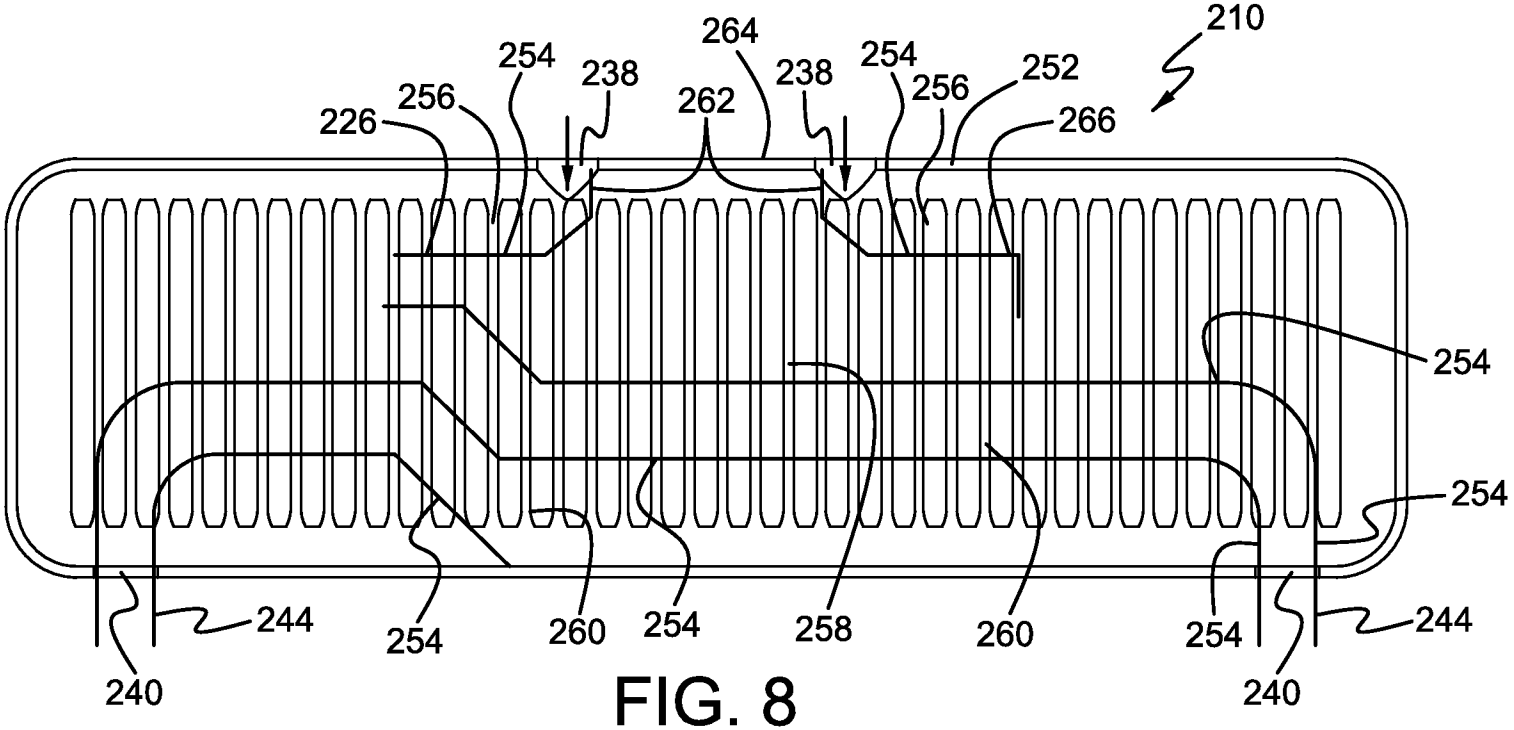
FIG. 8 is a top view of the bottom portion of the example muffler shown in FIG. 4 also illustrating a number of partitions arranged to form two example expansion chambers, an example balance passage, and two example tailpipe extensions.
Figure 9:
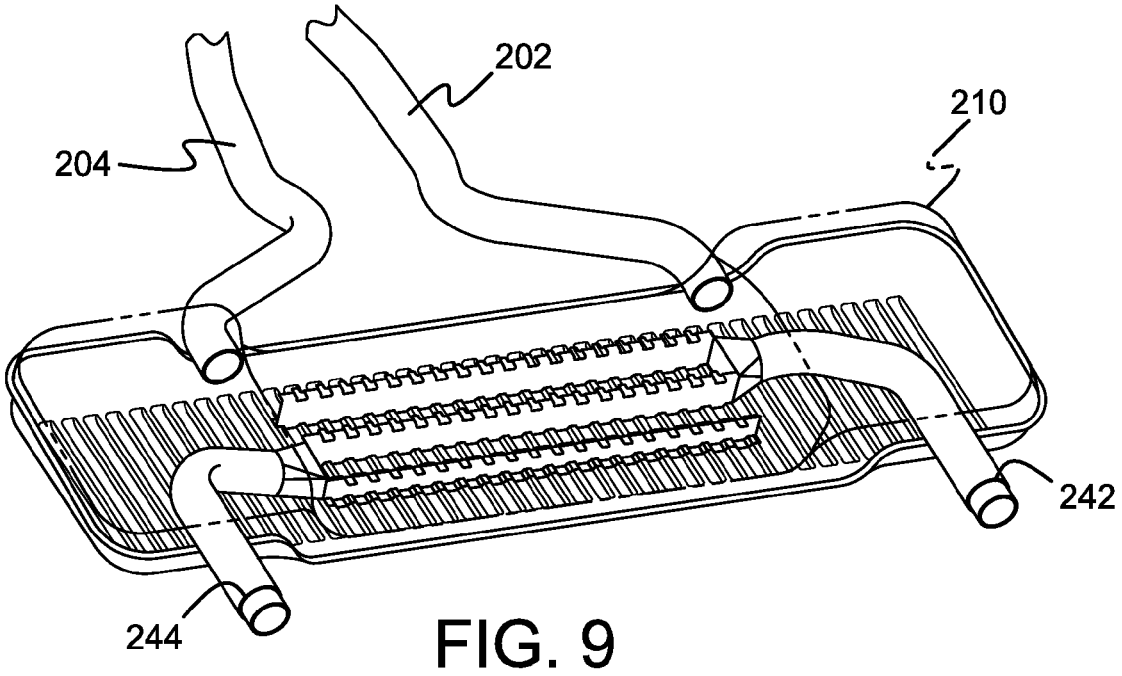
FIG. 9 is a perspective view of another example muffler and associated exhaust passages showing some portions of the muffler in phantom in order to illustrate selected interior features in accordance with the present disclosure.
Figure 10:
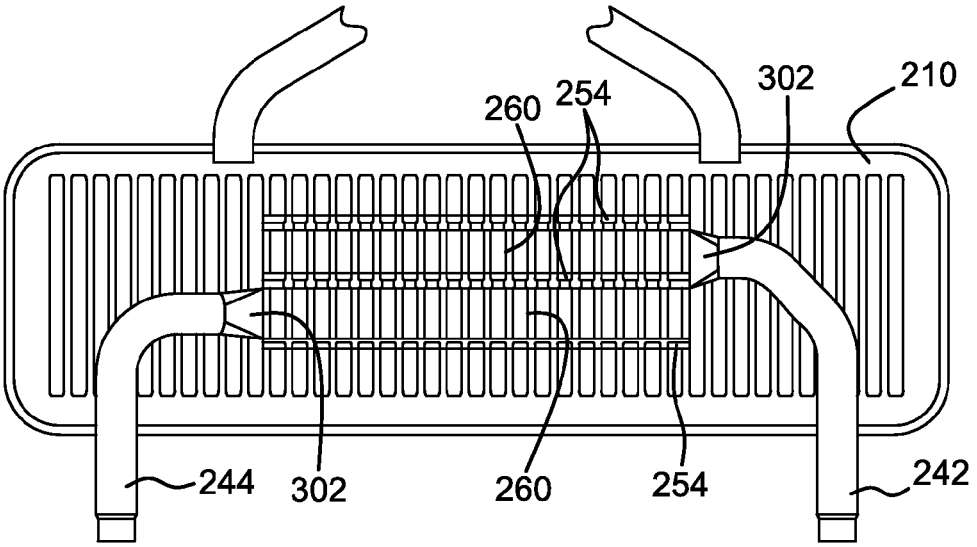
FIG. 10 is a top view of the muffler and associated exhaust passages shown in FIG. 9.

FIG. 8 is a top view of the bottom portion of the muffler 210 illustrating a number of partitions 254 arranged to form two example expansion chambers 256, an example balance passage 258, and two example tailpipe extensions 260. The outlet port 240 in each of the side sections 224 may be located at a downstream end of each respective tailpipe extension 260. The two outlet ports 240 may be configured to pass exhaust to two respective tailpipes 244 via the two respective tailpipe extensions 260. The balance passage 258, or balance tube, may fluidically inter-couple the side sections 224. The balance passage 258 may serve to equalize exhaust pulses and allow sounds waves to communicate between both banks of the engine. This may tend to produce a deeper less objectionable tone from the engine noise.

Embodiments may include two spaced apart inlets 238, or inlet ports 238 located at a side of the mid section 222 and configured to receive exhaust from an internal combustion engine. wherein a first and a second of the partitions 254 may each include a first portion 262 positioned to extend from the side 264 of the mid section 222 adjacent each respective entry port 238 in a first direction away from the side 264, and a second portion 266 positioned to extend in a second direction toward the side section 224 to direct the exhaust to each of the respective side sections 224.

Various embodiments may provide a muffler 210 including an enclosure 212. The enclosure 212 may include a relatively thin volume 222, fittable under a one or more preselected features of a vehicle 220. The one or more preselected features may be, for example, a spare tire well, or the like. The enclosure 212 may also include at least one relatively thick volume 224 fittable alongside the preselected feature, for example the spare tire well 218. The enclosure 212 may include an exhaust gas entry port 238, a tailpipe exit port 240, and partitions 254 within the thin volume 22. The partitions 254 may form an expansion chamber 256 at the entry port 238, and a tail pipe extension 260 at the exit port 240. The expansion chamber 256 may be formed just downstream from the entry port 238.

In some embodiments at least one relatively thick volume 224 is two relatively thick volumes 224 fluidically coupled to the thin volume 222 on opposite sides thereof. Both relatively thick volumes 224 may be configured to fit alongside the spare tire well 218. The entry port 238 may be two entry ports 238. The expansion chamber 256 may be two expansion chambers 256 that may be disposed directly downstream from the respective two entry ports 238. In addition to, or as an alternative to, allowing gas from the exhaust pipes 202 and 204 to expand, the expansion chamber 256 may also be configured to direct the stream into the respective two relatively thick volumes 224. The partitions 254 may also form a balance tube 258 within the relatively thin volume 222 which may fluidically coupling the two relatively thick volumes 224.

The enclosure 212 may be formed from a top shell 250 coupled with a bottom shell 252. The bottom shell 252 may be tub shaped. The top shell 250 may include wide approximately U shaped side walls and three top surfaces 270 including a lower middle surface 272 and two relatively higher side surfaces 274. With some examples the top shell 250 and the bottom shell 252 may be molded plastic shells. With some other examples the top shell 250 and the bottom shell 252 may be formed from one or more stamping operations. In one example, a single stamping may be used.

Various embodiments may provide a dual exhaust system 200. The dual exhaust system 200 may include at least two exhaust passages 202, 204 in fluidic communication with respective two banks of combustion chambers of an internal combustion engine. The exhaust system 200 may include first and second resonator chambers 224 in fluidic communication with the two respective exhaust passages 202, 204. At least two tailpipe passages 260 may be in fluidic communication with the first and second resonator chambers 224. A balance passage 258 may fluidically inter-couple the first and second resonator chambers 224. A portion of the each of the two exhaust passages 202, 204, a portion of the each of the two tailpipe passages 260, and the balance passage 258 may all be co-located within a middle volume 222 included in an enclosure 212. The first and second resonator chambers 224 may be located in the enclosure 212 on opposite sides of the middle volume 222.

In some examples the first and second resonator chambers 224 may occupy relatively thick volumes and the middle volume 222 may occupy a relatively thin volume. The enclosure 212 may have a cross-sectional shape approximating a wide square U shape.

The dual exhaust system 200 may include, or, be coupled with, or located adjacent to a spare tire wheel well 218. The enclosure 212 may fit around the spare tire wheel well 218. The first and second resonator chambers 224 may be located at a height in a vehicle 220 approximately at a height of a spare tire 235, and only radially outside of a circumference of the spare tire well 218. The middle volume 222 may be located below the spare tire well 218.

The middle volume 222 may include a first and a second partition 254 extending from respective sides of inlet holes 238 forming respective first and second expansion chambers 256 at ends of exhaust pipes 202, 204 between a top surface 280 and a bottom surface 282 (FIG. 3) of the middle volume 222 and between a side wall 264 (FIG. 8) of the enclosure 212 and the first and second partitions 254. A third partition 254 may be at a spaced apart distance from the first and second partitions 254 and may form the balance passage 258 between the top and bottom surfaces 280, 282 of the middle volume 222 and the third partition 254 and the first and second partitions 254. A fourth partition 254 may be located at a second spaced apart distance from the third partition 254 forming a first tailpipe extension 260 on a first side of the fourth partition 254 between the top and bottom surfaces 280, 282 of the middle volume 222, and a second tailpipe extension 260 on a second side of the fourth partition 254 between the top and bottom surfaces 280, 282 of the middle volume 222.

Referring now to FIGS. 9-13, and in some cases where indicated below, referring also to figures previously discussed, another example embodiment is illustrated in accordance with the present disclosure. The expansion chamber 256 may be formed at one or more entry ports 238, and in one example may be a configured as a change in cross sectional area of the path along which the exhaust may travel. In some cases the path into the expansion chamber 256 may be unobstructed. In other cases the path may include one or more baffles, partitions 254, or other object or the like. Baffles or walls and/or the partitions 254 may be integrated anywhere in the enclosure 210. In this way various tuning volumes may be formed within the enclosure 212.

One or more of the partitions 254 may have alternative preselected lengths selected in accordance with preselected criteria to tune the resonance and/or the sound produced by the muffler. Various embodiments may include adjustable partitions configurable in alternative lengths that may accordingly vary respective lengths, and/or sizes of the expansion chamber(s) 256, tailpipe extension(s) 260, and one or more balance passages 258.

In some examples the tailpipe extensions 260 may be tubular members located within the enclosure. The tubular members may be integral with portions of the tailpipes 242, 244 located external to the muffler. Various combinations may be used which may be determined based on, for example, manufacturer preferences, and/or manufacturing techniques and/or procedures. The tailpipe extension 260 may be two or more tailpipe extensions 260 that may have substantial rectangular cross sections. The muffler 210 may also include substantial rectangular end-forms 302 to mate the two or more tailpipe extensions 260 to respective two or more tailpipes 242, 244.

Figure 11:
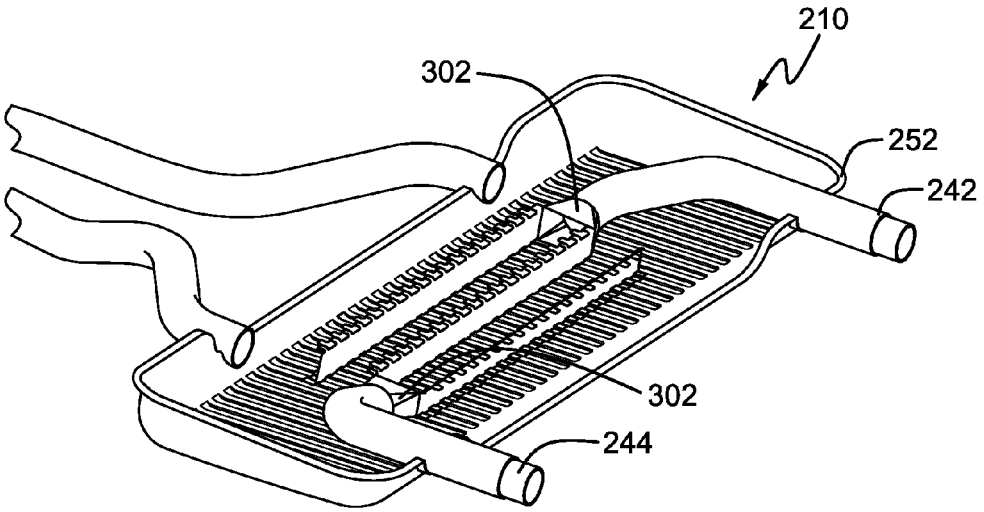
FIG. 11 is a perspective view of a bottom portion of the muffler and associated exhaust passages shown in FIG. 9.
Figure 12:
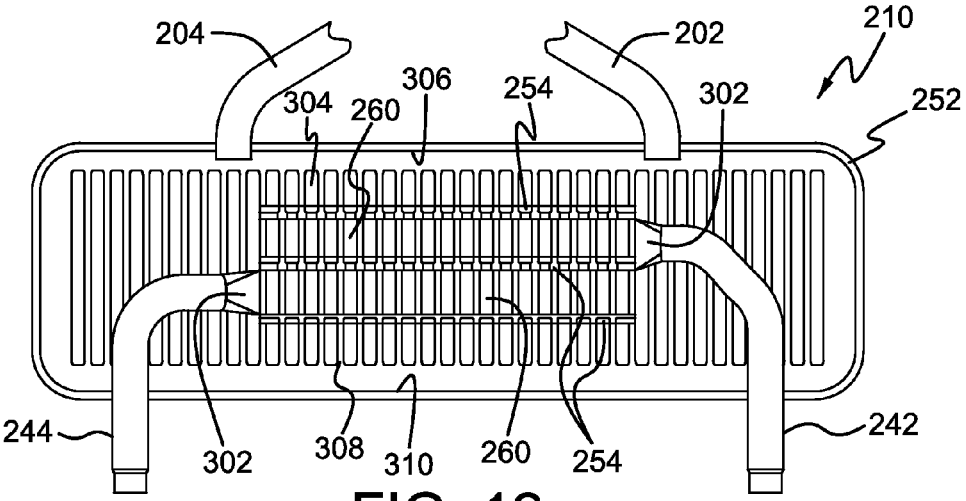
FIG. 12 is a top view of a bottom portion of the muffler and associated exhaust passages shown in FIG. 9.
Figure 13:
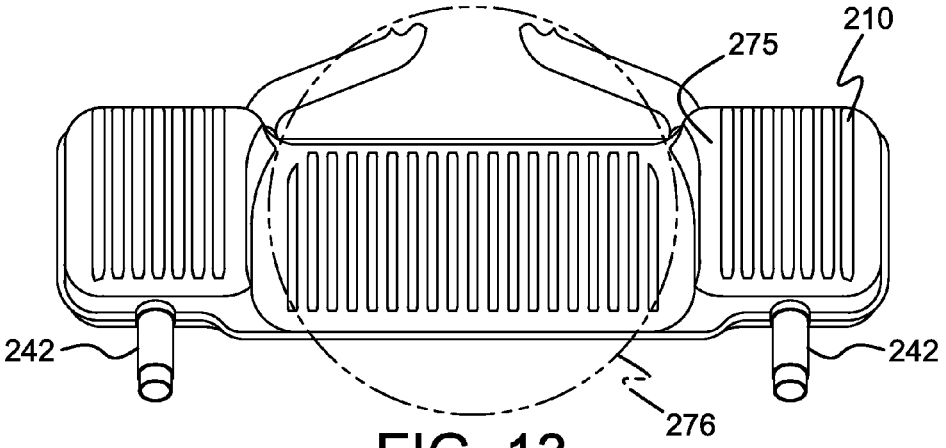
FIG. 13 is a top perspective view of the muffler and associated exhaust passages shown in FIG. 9 showing an example center depression, or center cut, profile shaped and sized in accordance with a spare tire well illustrated with a dashed line.

In some embodiments the partitions 254 may be positioned to form a first balance passage 304 located adjacent and substantially parallel (e.g., within 5%) with a forward wall 306 of the enclosure 212, and a second balance passage 308 located adjacent and substantially parallel with a rearward wall 310 of the enclosure 212 (FIG. 11). In some embodiments one tailpipe extension 260 may located a spaced apart distance from the forward wall 306 of the enclosure 212. A second tailpipe extension 260 may be located another spaced apart distance from the rearward wall 310 of the enclosure 212. Each spaced apart distance may be substantially equal (e.g., within 5%), or may be different.

The three top surfaces 270, including transition portions 271 (FIG. 6) may together define a top surface contour 275 (FIGS. 6 & 13) in the top portion 250 of the muffler 210. A substantially circular center depression 276 (FIG. 13) may be formed in the top surface contour 275 defined by the spare-tire well 218. Defined by the spare-tire well 218 may refer to, for example, locating and sizing the center depression 276, which may also be referred to as a center cut, in accordance with the location and size of the spare tire well 218 for use with a particular make and model, and/or configuration of a vehicle.

In some embodiments one or more of the partitions 254 may include tabs disposed substantially perpendicular to a substantially vertical face thereof. The tabs may be fixed to a top and/or a bottom inner face of the enclosure 212. The tabs may be bent portions of the partitions formed to protrude past a majority of an edge of the partitions 254. The tabs may be formed integral with each partition in, for example, a stamping operation or the like. They may be bent in a separate operation. The tabs may be tack welded to the bottom surface 282, and/or to the top surface 280 of the enclosure 212. The tabs may serve to allow access to spot-weld the tabs to the inner bottom surface 282 of the bottom shell 252. Then tabs may be projection welded to the upper shell 250 upon assembly. The partitions 254 may be made from sheet metal, or the like, or some other material. In some embodiments the partitions 254 may include opposite scalloped edges configured to fit adjacent to, or in contact with, the corrugated contours 237 of the respective top portion 250 and bottom portion 252 of the muffler 210.

In one example, where the exhaust system includes exactly two exhaust pipes, the exhaust system carries exhaust from two respective banks of cylinders to the muffler. The muffler may include balance tubes, or crossover pipes, that may fluidically couple the tubes and provide some mixing of the sound waves from both banks. This may create a deeper more mellow tone from the engine, and may also tend to improve engine torque at lower rpm ranges.

It should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A muffler comprising:

an enclosure including:

a relatively thin volume fittable under a preselected feature of a vehicle, and at least one relatively thick volume fittable alongside the preselected feature, an exhaust gas entry port, a tailpipe exit port, and partitions within the thin volume forming:

an expansion chamber at the entry port, and a tailpipe extension at the exit port, wherein the at least one relatively thick volume is two relatively thick volumes fluidically coupled to the thin volume on opposite sides thereof and both configured to fit alongside the preselected feature, the entry port being two entry ports, the expansion chamber being two expansion chambers directly downstream from the respective two entry ports and configured to direct a stream into the respective two relatively thick volumes; and the partitions also forming a balance tube within the relatively thin volume fluidically coupling the two relatively thick volumes.

2. The muffler of claim 1, wherein the at least one relatively thick volume is an expansion chamber for an inlet/outlet exhaust system.

3. The muffler of claim 1, wherein the enclosure is formed from a top shell coupled with a bottom shell, wherein the bottom shell is tub shaped, and the top shell includes wide approximately U shaped side walls and three top surfaces including a lower middle surface and two relatively higher side surfaces.

4. The muffler of claim 3, wherein the top shell and the bottom shell are molded plastic shells.

5. The muffler of claim 1, wherein the tailpipe extension is a tubular member located within the enclosure.

6. The muffler of claim 1, wherein the tailpipe extension is two or more tailpipe extensions having substantial rectangular cross sections, further comprising substantial rectangular end-forms to mate the two or more tailpipe extensions to respective two or more tailpipes.

7. The muffler of claim 1, wherein the preselected feature is a spare tire well, and further comprising a top surface contour, a circular center depression formed in the top surface contour defined by the spare tire well.

8. The muffler of claim 1, wherein the partitions are positioned to form a first balance passage located adjacent and substantially parallel with a forward wall of the enclosure, and a second balance passage located adjacent and substantially parallel with a rearward wall of the enclosure, wherein the tailpipe extension is located a spaced apart distance from the forward wall of the enclosure, and further comprising a second tailpipe extension located another spaced apart distance from the rearward wall of the enclosure.

9. The muffler of claim 1, wherein one or more of the partitions include tabs disposed substantially perpendicular to a substantially vertical face of the one or more partitions, the tabs being fixed to a top and/or a bottom inner surface face of the enclosure.

10. The muffler of claim 1, wherein the enclosure includes a number of surfaces having corrugated contours.

11. The muffler of claim 1, wherein the relatively thin volume includes two inlets each respectively coupled with dual exhaust pipes for exhausting gas from two respective banks of cylinders of a combustion engine.

12. The muffler of claim 1, wherein a path into the expansion chamber includes one or more partitions.

13. The muffler of claim 1, wherein a path into the expansion chamber includes one or more baffles.

14. The muffler of claim 12, wherein the one or more partitions includes adjustable partitions configurable in alternative lengths that vary respective lengths, and/or sizes of the expansion chamber, tailpipe extension, and one or more balance passages.

15. A muffler comprising:
an enclosure including:
a relatively thin volume fittable under a preselected feature of a vehicle,
two relatively thick volumes fittable alongside the preselected feature,
two exhaust gas entry ports,
two tailpipe exit ports, and
partitions within the thin volume,
wherein the two relatively thick volumes are fluidically coupled to the thin volume on opposite sides thereof and both configured to fit alongside the preselected feature, and wherein a stream is directed from the two exhaust gas entry ports to the two relatively thick volumes.

16. A muffler comprising:
an enclosure including:
a relatively thin volume fittable under a preselected feature of a vehicle, and
at least one relatively thick volume fittable alongside the preselected feature,
an exhaust gas entry port,
a tailpipe exit port, and
partitions within the thin volume forming:
an expansion chamber at the entry port, and
a tailpipe extension at the exit port,
wherein the enclosure is formed from a top shell coupled with a bottom shell, wherein the bottom shell is tub shaped, and the top shell includes wide approximately U shaped side walls and three top surfaces including a lower middle surface and two relatively higher side surfaces.

17. The muffler of claim 16, wherein the top shell and the bottom shell are molded plastic shells.

* * * * *